US010820116B2

(12) United States Patent
Gu

(10) Patent No.: US 10,820,116 B2
(45) Date of Patent: Oct. 27, 2020

(54) SPEAKER

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/529,794

(22) Filed: Aug. 2, 2019

(65) Prior Publication Data

US 2020/0059729 A1 Feb. 20, 2020

(30) Foreign Application Priority Data

Aug. 17, 2018 (CN) ..... 2018 2 1330112 U

(51) Int. Cl.
*H04R 9/06* (2006.01)
*H04R 9/02* (2006.01)
*H04R 1/06* (2006.01)

(52) U.S. Cl.
CPC ..... *H04R 9/06* (2013.01); *H04R 1/06* (2013.01); *H04R 9/025* (2013.01); *H04R 2400/11* (2013.01)

(58) Field of Classification Search
None
See application file for complete search history.

(56) References Cited

U.S. PATENT DOCUMENTS

2004/0218779 A1* 11/2004 Fukuyama ..... H04R 9/02 381/409
2009/0304223 A1* 12/2009 Chang ..... H04R 31/006 381/412
2012/0128195 A1* 5/2012 Liu ..... H04R 7/18 381/386
2016/0021460 A1* 1/2016 Shi ..... H04R 9/025 381/398
2016/0241938 A1* 8/2016 Huang ..... H04R 1/023
2018/0115828 A1* 4/2018 Zhang ..... H04R 9/06

* cited by examiner

*Primary Examiner* — Tuan D Nguyen
(74) *Attorney, Agent, or Firm* — W&G Law Group LLP

(57) ABSTRACT

The present application discloses a speaker includes a frame, a vibration system accommodated in the frame, the vibration system comprising a diaphragm, a voice coil for driving the diaphragm to generate sounds. Wherein, the voice coil comprises a pair of voice coil leading wires; a magnetic circuit system accommodated in the frame, the magnetic circuit system comprising a yoke, a main magnet, an auxiliary magnet surrounding the main magnet and spaced from the main magnet for forming a magnetic gap, an upper plate attached to the auxiliary magnet; the upper plate includes a base portion, an extending portion extending from an edge of the base portion in a direction away from the base portion, and a bending portion connected with the extending portion and bent and extends toward the yoke; the frame wraps on the extending portion and the bending portion by means of injection molding.

12 Claims, 3 Drawing Sheets

SPEAKER

FIELD OF THE PRESENT DISCLOSURE

The present disclosure relates to the field of speaker, and more particularly to an upper plate of a speaker.

DESCRIPTION OF RELATED ART

In order to adapt to the miniaturization and multi-functional development of various audio equipments and information communication equipments, the sound generators used in such equipments need to be more miniaturized, and the cooperation with other components around the sound generators is more compact. In particular, with the development of mobile phones, the mobile phones may be thinner and lighter, thus, the speakers used therein require not only miniaturization but also high sound quality and stereo.

A related speaker includes a frame, a vibration unit and a magnetic circuit unit both received in the frame. The vibration unit includes a diaphragm and a voice coil configured for driving the diaphragm to vibrate. The magnetic circuit unit includes a yoke, a main magnet attached upon the yoke, an auxiliary magnet surrounding the main magnet and spaced away from the magnet for forming a magnet gap, and an upper plate attached upon the auxiliary magnet. The upper plate includes a fixing portion bending outwardly. The frame wraps on the fixing portion by means of injection molding for fixing the upper plate. With such configuration, if the upper plate is subjected to excessive pressure, the fixing portion is flattened, and the flattened fixing portion is in contact with a conductive member, which may cause a short-circuit problem of the product.

Therefore, it is desirable to provide a new speaker which can overcome the above-mentioned problems.

DETAILED DESCRIPTION OF THE EXEMPLARY EMBODIMENT

The present disclosure will hereinafter be described in detail with reference to exemplary embodiment and FIGS. 1-4.

Figure 1:
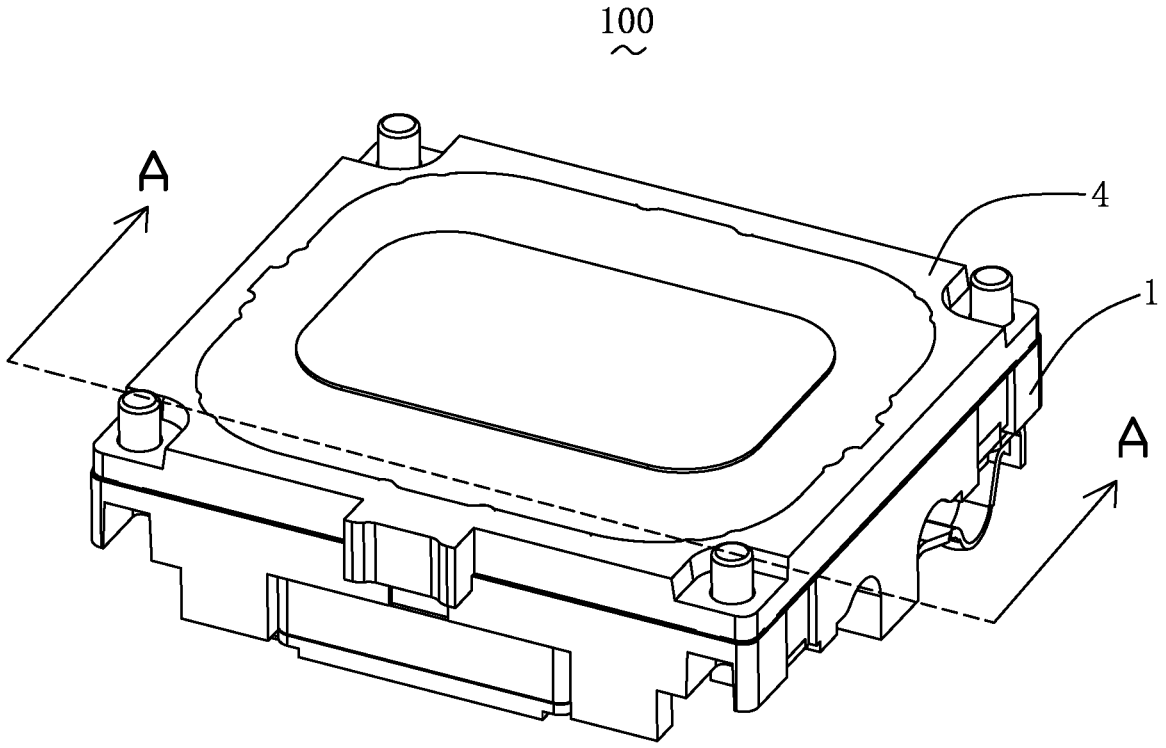
FIG. 1 is an isometric view of a speaker in accordance with an embodiment of the present invention.
Figure 2:
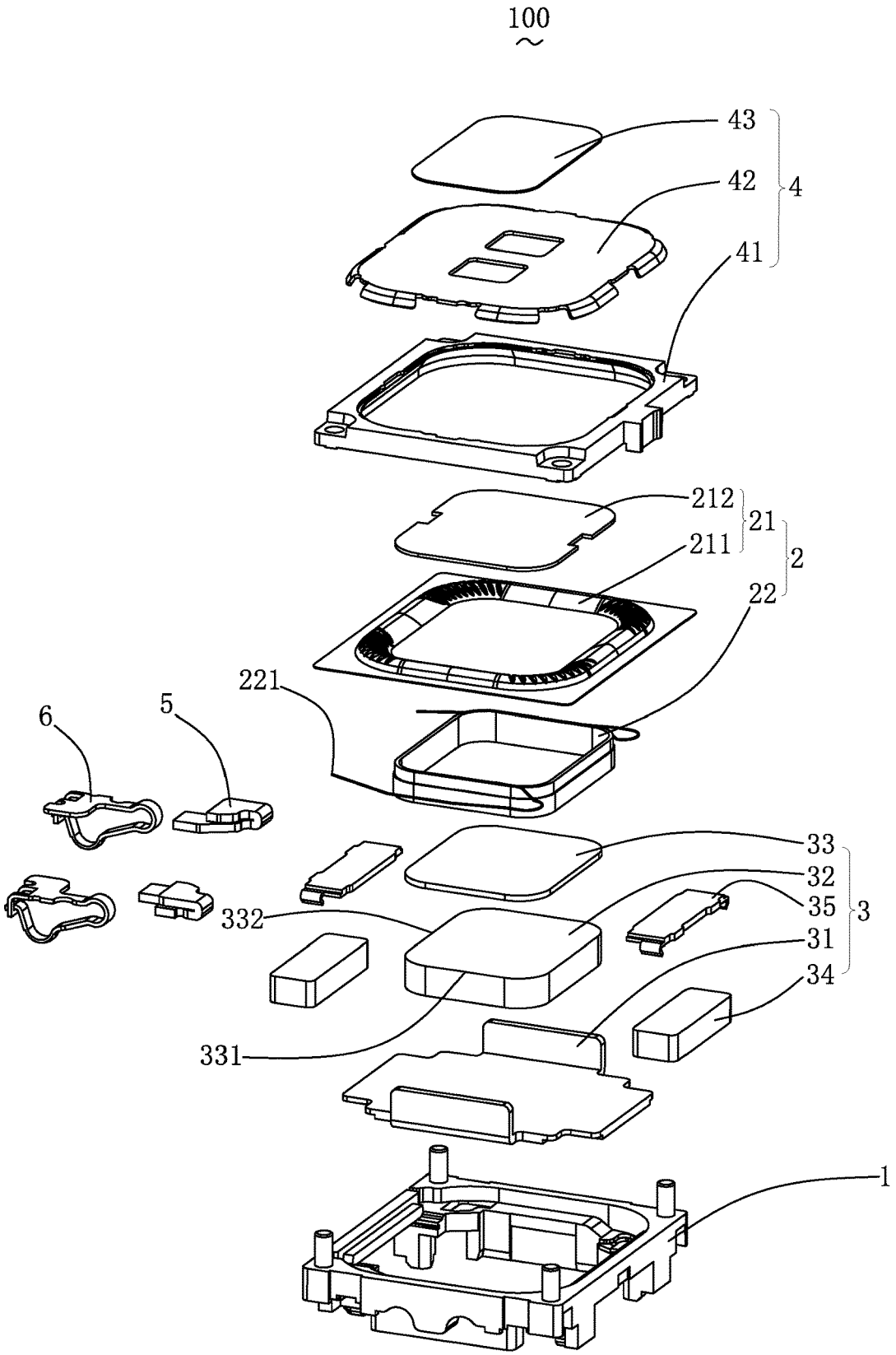
FIG. 2 is an isometric and exploded view of the speaker in FIG. 1.

Referring to FIGS. 1-2, a speaker 100 includes a frame 1, an upper cover 4 mounted on the frame 1, and a vibration system 2 and a magnetic circuit system 3 accommodated in the frame 1. The upper cover 4 comprises a fixing frame 41 fixed on the frame 1, a metal sheet 42 embedded into the fixing frame 41, and a damping net 43 attached onto the metal sheet 42. The vibration system 2 comprises a diaphragm 21 and a voice coil 22 for driving the diaphragm 21 to generate sound. The diaphragm 21 comprises an edge 211 and a doom 212 attached to the edge 211. The voice coil 22 comprises a pair of voice coil leading wires 221. The speaker 100 further comprises a conductive member 5 electrically connected with the pair of voice coil leading wires 221 and a pin 6 electrically connected with the conductive member 5. The conductive member 5 and the pin 6 are embedded into the frame 1. The magnetic circuit system 3 comprises a yoke 31, a main magnet 32 mounted on the yoke 31, a pole plate 33 attached on the main magnet 32, an auxiliary magnet 34 surrounding the main magnet 32 and spaced away from the main magnet 34 for forming a magnet gap, and an upper plate 35 attached on the auxiliary magnet 34. The main magnet 34 comprises a pair of short sides 331 and a pair of length sides 332 connected to the short sides 331. There are two auxiliary magnets 34 and two upper plates 35. Each one of the auxiliary magnets 34 and upper plates 35 are positioned at an outside of the length side 332, respectively.

Figure 3:
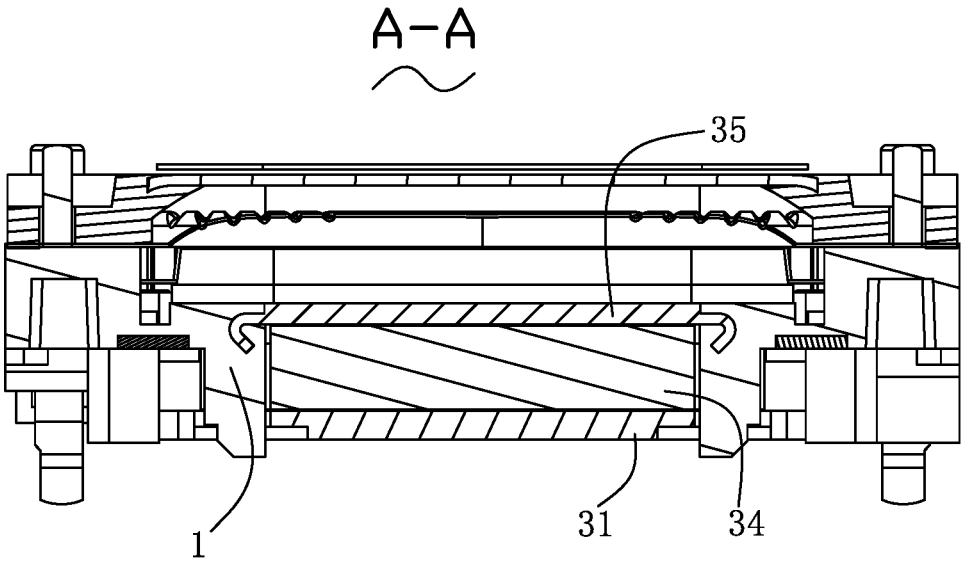
FIG. 3 is a cross-sectional view of the speaker taken along line A-A of FIG. 1.
Figure 4:
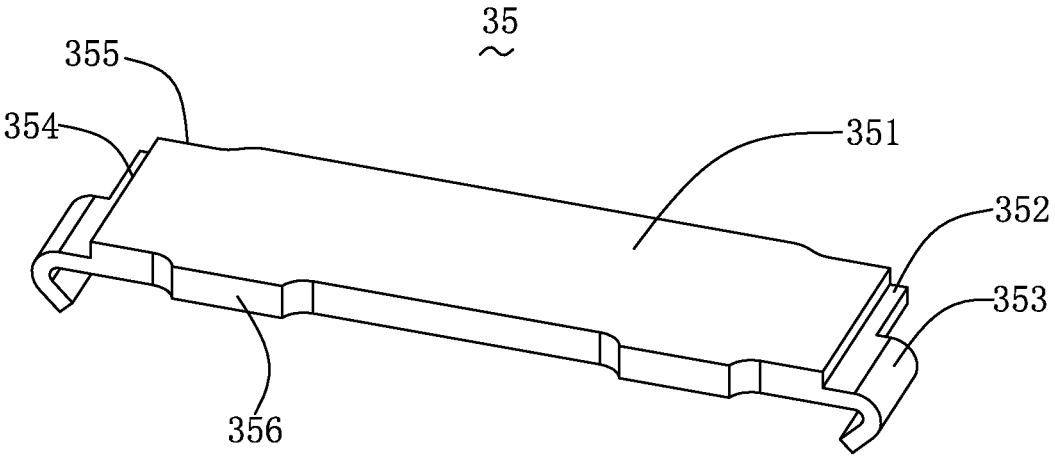
FIG. 4 is an isometric view of an upper plate of the speaker.

Referring to FIG. 3 and FIG. 4, the upper plate 35 comprises a base portion 351, an extending portion 352 extending from a periphery of the base portion 351 in a direction away from the base portion 351, and a bending portion 353 bent and extends toward the yoke 31 and connected with the extending portion 352. The frame 1 wraps on the extending portion 352 and the bending portion 353 by means of injection molding. The upper plate 35 comprises a short axis side 354, a long axis side 355 connected with the short axis side 354 and a protrusion 356 positioned at the long axis side 355 extending outwardly from the base portion 351. A thickness of the protrusion 356 is equal to that of the base portion 351. The protrusion 356 can improve the strength of the upper plate 35. The extending portion 352 and bending portion 353 are positioned at the short axis side 354.

The extending portion 352 extends horizontally from the base portion 351. An angle formed between the extending portion 352 and the bending portion 353 is less than 90°. A thickness of the extending portion 352 is equal to that of the bending portion 353. The thickness of the extending portion 352 is less than that of the base portion 351, with such configuration, the bending portion 353 is prevented from being too thick to occupy excessive space. A width of the bending portion 353 is less than that of the extending portion 352, which is benefit for reducing a space occupied by the upper plate 35.

The present invention has advantages that the speaker has the bending portion bent and extends toward the yoke, thus, the bending portion extends away from the conductive member so that the upper plate would not extend toward the conductive member under pressure, thereby avoiding a short circuit problem which caused by the upper plate extended outward and in contact with the conductive member, thereby improving the stability of the speaker.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, comprising:

a frame;

a vibration system accommodated in the frame, the vibration system comprising a diaphragm, a voice coil for driving the diaphragm to generate sounds, wherein, the voice coil comprises a pair of voice coil leading wires;

a magnetic circuit system accommodated in the frame, the magnetic circuit system comprising a yoke, a main magnet mounted on the yoke, an auxiliary magnet surrounding the main magnet and spaced away from the main magnet for forming a magnet gap, and an upper plate attached to the auxiliary magnet;

wherein, the upper plate comprises a base portion, an extending portion extending from an edge of the base portion in a direction away from the base portion, and a bending portion connected with the extending portion, the bending portion bent and extends toward the yoke; and the frame wraps on the extending portion and the bending portion by means of injection molding.

2. The speaker according to claim 1, wherein the extending portion extends horizontally from the base portion, an angle formed between the extending portion and the bending portion is less than 90°.

3. The speaker according to claim 2, wherein the upper plate has two short axis sides and two long axis sides connected with the short axis sides, the extending portion and the bending portion positioned at each of the short axis sides.

4. The speaker according to claim 3, wherein at least one protrusions extend outwardly positioned at the long axis side; a thickness of the protrusion is equal to that of the base portion.

5. The speaker according to claim 1, wherein the upper plate has two short axis sides and two long axis sides connected with the short axis sides, the extending portion and the bending portion positioned at each of the short axis sides.

6. The speaker according to claim 5, wherein at least one protrusions extend outwardly positioned at the long axis side; a thickness of the protrusion is equal to that of the base portion.

7. The speaker according to claim 1, wherein a thickness of the extending portion is equal to that of the bending portion.

8. The speaker according to claim 7, wherein a thickness of the extending portion is less than that of the base portion.

9. The speaker according to claim 1, wherein a thickness of the extending portion is less than that of the base portion.

10. The speaker according to claim 1, wherein a width of the extending portion is greater than that of the bending portion.

11. The speaker according to claim 1, wherein the main magnet comprises a pair of short sides and a pair of long sides connected with the short sides, each auxiliary magnet and upper plate is positioned at an outside of each long side of the main magnet.

12. The speaker according to claim 1, further comprising a conductive member electrically connected with the pair of voice coil leading wires, the conductive member embedded into the frame, the bending portion extending from the extending portion in a direction away from the conductive member.

* * * * *